US006764287B2

(12) United States Patent
Yamakawa

(10) Patent No.: US 6,764,287 B2
(45) Date of Patent: Jul. 20, 2004

(54) PUMP PROVIDED WITH DIAPHRAGMS

(75) Inventor: Muneharu Yamakawa, Inagi (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 15 days.

(21) Appl. No.: 10/208,814

(22) Filed: Aug. 1, 2002

(65) Prior Publication Data

US 2003/0031571 A1 Feb. 13, 2003

(30) Foreign Application Priority Data

Aug. 10, 2001 (JP) ..... P2001-243223

(51) Int. Cl.[7] ..... F04B 53/00
(52) U.S. Cl. ..... 417/523; 417/495; 417/413.1
(58) Field of Search ..... 417/523, 495, 417/412, 413.1, 420, 269; 92/89.96; 418/45, 50

(56) References Cited

U.S. PATENT DOCUMENTS 3,922,119 A * 11/1975 Rosenquist ..... 418/45
5,476,367 A * 12/1995 Zimmermann et al. ..... 417/307
6,206,664 B1 * 3/2001 Kakizawa ..... 417/569
6,296,460 B1 * 10/2001 Smith ..... 417/475
6,506,033 B2 * 1/2003 Fukami ..... 417/420

FOREIGN PATENT DOCUMENTS

JP 62-291484 A * 12/1987

* cited by examiner

*Primary Examiner*—Justine R. Yu
*Assistant Examiner*—Han L Liu
(74) *Attorney, Agent, or Firm*—Whitham, Curtis & Christofferson, PC

(57) ABSTRACT

A casing body is formed with a vent hole. The casing body has an inner face formed with a plurality of grooves respectively communicated with the vent hole. A plurality of diaphragms are respectively inserted into the grooves to form a plurality of pump chambers. An actuator actuates the diaphragms to compress or decompress the pump chambers.

2 Claims, 4 Drawing Sheets

PUMP PROVIDED WITH DIAPHRAGMS

BACKGROUND OF THE INVENTION

The invention relates to a pump provided with diaphragms, and more particularly, to a compact pump which is used for a sphygmomanometer or the like.

A related-art compact pump of this type is now described by reference to FIGS. 3 and 4. As shown in FIG. 3, a compact pump 1 used for a sphygmomanometer or the like is provided with two diaphragms 4 constituting pump chambers 3 within a case 2 which is of rectangular parallelepiped shape when viewed from the top. The diaphragms 4 are integrated, thereby constituting a diaphragm assembly 5.

A substantially-cylindrical vent valve section 6 is provided in an upright position in the center of the diaphragm assembly 5. The vent valve section 6 is press-inserted into an interior wall of a vent hole 8 drilled in the center of an upper case 7.

Intake valves 9 are provided in positions on the upper case 7 which are located above and aligned with centers of the respective diaphragms 4. Portions of the intake valves 9 facing the pump chambers 3 are formed into sealing sections 9*a*. The intake valves 9 are passed through small holes 10 drilled in the upper case 7. Stopper sections 9*b* which are larger in diameter than the small holes 10 are formed in the upper face of the upper case 7. The sealing sections 9*a* are brought into pressing contact with a lower face of the upper case 7. Several intake holes 11 are drilled in the vicinity of the peripheries of the small holes 10, and the sealing sections 9*a* of the intake valves 9 seal the intake holes 11.

A pivotable member 12 is pivotally joined to lower ends of the diaphragms 4. The pivotable member 12 is constructed so as to pivot, by an eccentric shaft 13 which rotates. More specifically, an upper end of the eccentric shaft 13 is fitted into an insertion hole 14*a* formed in a boss section 14 formed so as to protrude downward from the center on a lower face of the pivotable member 12. A lower end of the eccentric shaft 13 is loosely fitted into an eccentric hole 15*a* eccentrically formed in a rotor 15. The rotor 15 is secured on an end of a rotary shaft 16 of a motor (not shown).

FIG. 4 is a bottom view of the upper case 7. Formed in the bottom face of the upper case 7 are the vent hole 8 and vent grooves 17 for establishing communication with the pump chambers 3 provided in the diaphragms 4.

The rotary drive shaft 16 of the motor rotates, whereupon the rotor 15 rotates. In turn, the eccentric shaft 13 loosely fitted into the eccentric hole 15*a* of rotor 15 is rotated, whereupon the pivotable member 12 undergoes pivotal movement, to thereby vertically actuate the lower ends of the diaphragms 4. When the lower end of one of the diaphragms 4 is lowered by the pivotable member 12, the inside of the diaphragm 4 assumes negative pressure, and the vent valve section 6 seals the vent hole 8. Further, the sealing section 9*a* of the intake valve 9 is opened, thereby enabling inflow of air by way of the inlet hole 11.

Next, when the lower end of one of the diaphragms 4 is actuated upward, the inside of the diaphragm 4 assumes high pressure. The sealing section 9*a* of the intake valve 9 brings the inlet hole 11 into a sealed state, releasing the space between the vent valve section 6 and the vent hole 8. The air of the pump chamber 3 is discharged to the outside from the vent hole 8 by way of the vent groove 17.

In the related-art compact pump, it is necessary to provide intake valves 9 which are individual members, to drill the small hole 10 and the intake holes 11, and to take care of position matching of the sealing portion 9*a* of the intake valve 9 and the inlet holes 11. Hence, the numbers of parts and assembling operations are accordingly increased, thereby total cost is also increased.

SUMMARY OF THE INVENTION

It is therefore an object of the present invention to provide a pump provided with diaphragms, in which a decrease in the numbers of parts and assembling operations by use of a simple construction to thereby enable cost cutting.

In order to achieve the above object, according to the present invention, there is provided a pump, comprising:

a casing body formed with a vent hole, the casing body having an inner face formed with a plurality of grooves respectively communicated with the vent hole;

a plurality of diaphragms, respectively inserted into the grooves to form a plurality of pump chambers; and an actuator, which actuates the diaphragms to compress or decompress the pump chambers.

Preferably, the actuator is formed with a plurality of intake holes, and each of the diaphragm is provided with an intake valve section communicated with an associated one of the intake holes.

Here, it is preferable that the intake valve section is a flap member formed by incising a part of each diaphragm.

In the above configurations, since the grooves into which the diaphragms are inserted form a part of the vent hole, it is not necessary to separately provide such a member as the intake valve member shown in FIG. 3, and to separately drill such holes as the intake hole and the vent groove shown in FIG. 4, thereby, enabling a decrease in the numbers of parts and assembly operations by use of a simple structure and in turn enabling cost cutting.

DETAILED DESCRIPTION OF THE PREFERRED EMBODIMENTS

Figure 1:
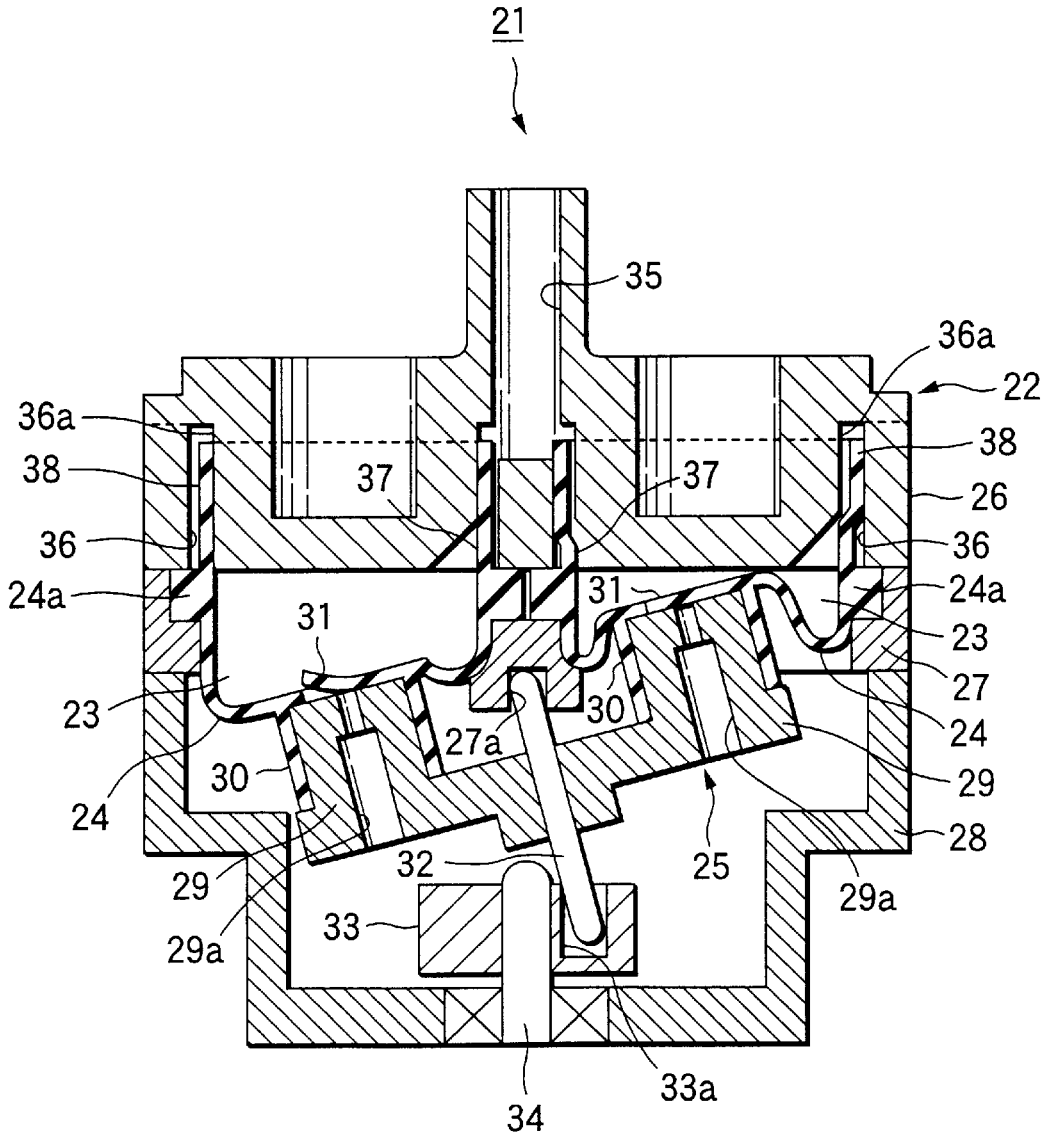
FIG. 1 is a longitudinal cross-sectional view of a pump according to an embodiment of the invention.

One embodiment of the invention will be described in detail by reference to FIGS. 1 and 2. As shown in FIG. 1, a compact pump 21 is equipped with two diaphragms 24 partly constituting pump chambers 23 within a case 22 which is of rectangular parallelepiped shape when viewed from the top. Provided below the diaphragms 24 is a pivotable member 25 which vertically actuates lower faces of the diaphragms 24. The case 22 is constituted of three stages; that is, an upper case 26, a middle case 27, and a lower case 28. Flanges 24*a* of the diaphragms 24 are sandwiched between the upper case 26 and the middle case 27, whereby the diaphragms 24 are retained in the case 22.

Shaft members 29 are provided at respective ends of the pivotable member 25 so as to protrude upward, and intake holes 29*a* are formed in the centers of the respective shaft members 29. Hollow attachment members 30, 30 are provided so as to protrude in the centers on the lower faces of the respective diaphragms 24. The shaft members 29 are hermetically fitted into the hollow attachment members 30, whereby the diaphragms 24 are attached to the pivotable member 25.

Portions of the bottom centers of the diaphragms 24 corresponding to the intake holes 29*a* are incised, whereby flap-like intake valve sections 31 are formed in a reclosable manner. A method of forming the intake valve sections 31 is not limited to the incision method but may be another method.

An eccentric rotary shaft 32, which is pivoted by eccentric rotation of the pivotable member 25, is passed through and fixed to the center of the pivotable member. A lower end of the rotary shaft 32 is loosely fitted into an eccentric hole 33*a* eccentrically drilled in a rotor 33. The rotor 33 is secured to an upper end of the rotary shaft 34 of a motor (not shown). An upper end of the eccentric rotary shaft 32 is loosely fitted into an indentation 27*a* drilled in the center of the center case 27.

Figure 2:
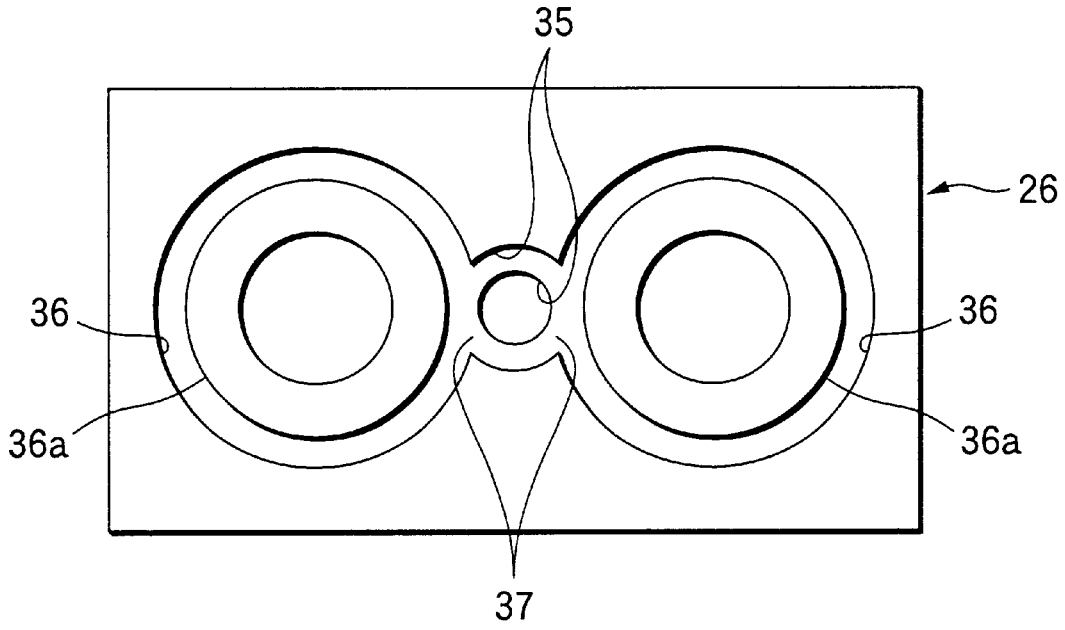
FIG. 2 is a bottom view of an upper case of the pump.

As shown in FIG. 2, a vent hole 35 is formed in the center of the case 26. Formed in the lower face of the upper case 26 are annular recessed grooves 36 for enabling insertion of upper ends of the diaphragms 24. An outer periphery of the vent hole 35 is communicated with outer peripheries of the annular recessed grooves 36, thereby forming air communication ports 37.

The upper ends of the diaphragms 24 are brought into pressing contact with inner wall sections 36*a* of the annular recessed grooves 36, thereby constituting vent valve sections 38.

When the rotor 33 is rotated as a result of rotation of the rotary drive shaft 34, the eccentric rotary shaft 32 rotates eccentrically. As a result, the pivotable member 25 is pivoted, thereby vertically actuating lower end sections of the diaphragms 24. For instance, when the lower end of one of the diaphragms 24 is actuated downward, the inside of the diaphragm 24 assumes negative pressure. The vent valve section 38 is brought into intimate contact with the interior wall face 36*a* of the annular recessed groove 36, thereby sealing the upper portion of the pump chamber 23. On the other hand, the intake valve section 31 is opened, thereby enabling air inflow from the intake hole 29*a* to the inside of the diaphragm 24.

When the lower end of the diaphragm 24 is actuated upward, the inside of the diaphragm 24 assumes high pressure. When the air intake valve section 31 closes the intake hole 29*a*, while the vent valve section 38 departs from the corresponding wall interior wall face 36*a*, thereby venting air. The vented air from the vent valve section 38 is discharged to the outside of the case 22 from the vent hole 35 by way of the annular recessed groove 36 and the air communication port 37.

Figure 3:
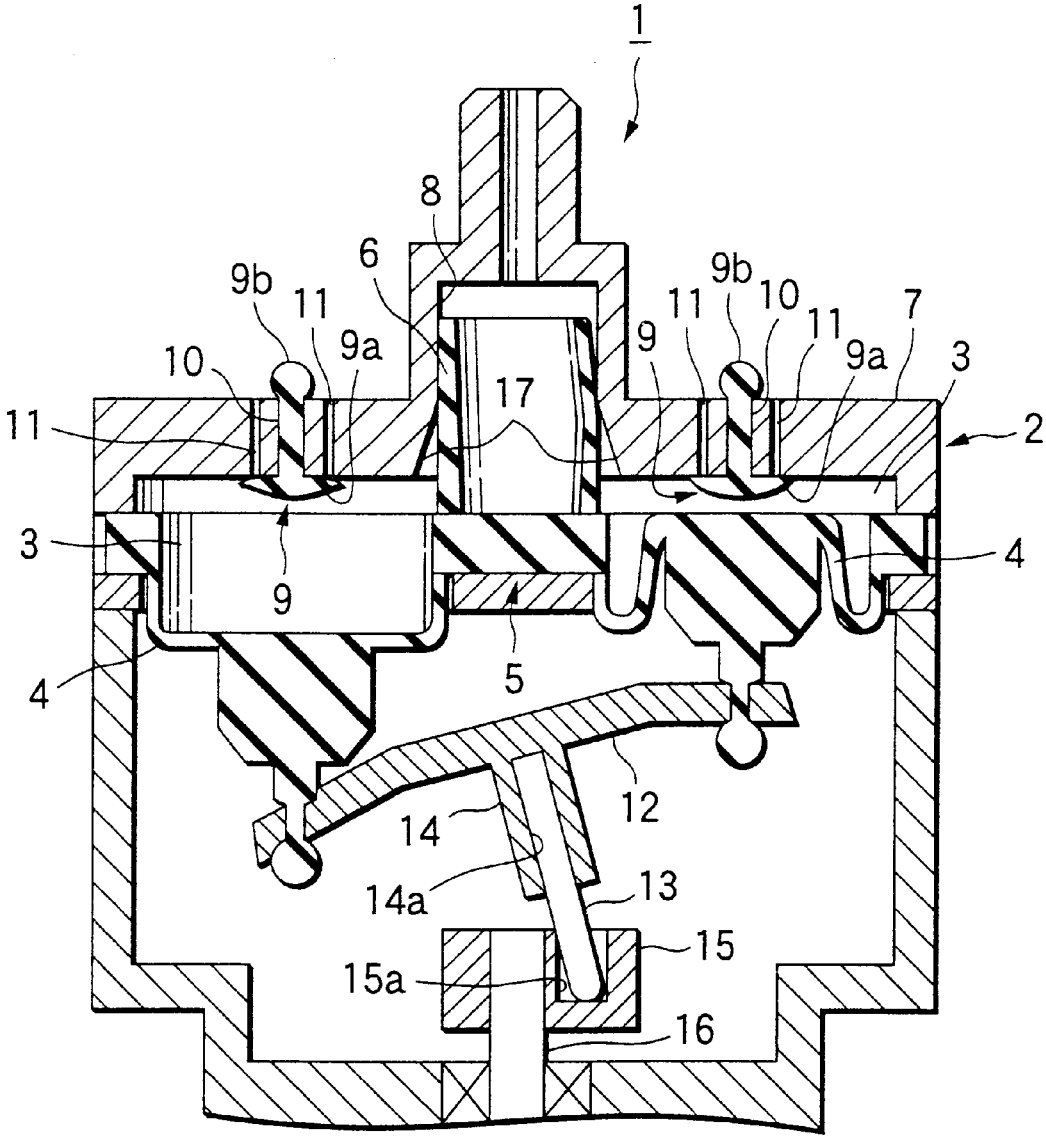
FIG.3 (PRIOR ART)
FIG. 3 is a longitudinal cross-sectional view of a related-art pump.
Figure 4:
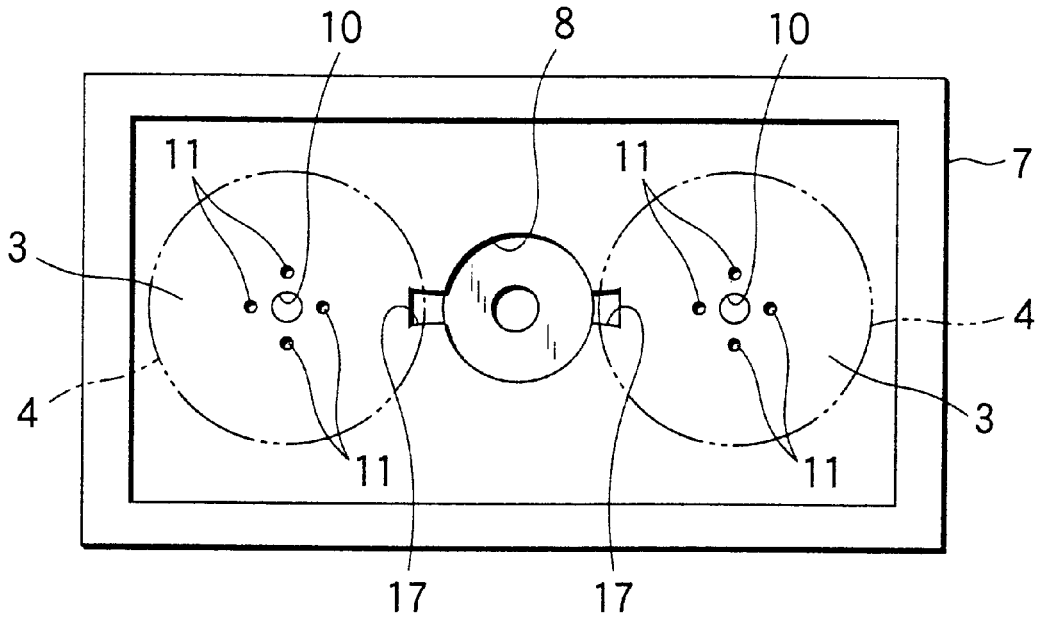
FIG.4 (PRIOR ART)
FIG. 4 is a bottom view of an upper case of the related-art pump.

In this embodiment, since parts of the annular recessed grooves 36 into which the upper part of the diaphragms 24 are inserted to form the air communication port 37, it is not necessary to separately provide such a member as the intake valve member 9 shown in FIG. 3, and to separately drill such holes as the intake hole 11 and the vent groove 17 shown in FIG. 4, thereby, enabling a decrease in the numbers of parts and assembly operations by use of a simple structure and in turn enabling cost cutting.

As a matter of course, the present invention is susceptible to various modifications within the scope of the invention, and the modifications fall within the scope of the invention.

What is claimed is:

1. A pump, comprising:

a casing body formed with a vent hole, the casing body having an inner face formed with a plurality of grooves respectively communicated with the vent hole;

a plurality of diaphragms, respectively inserted into the grooves to form a plurality of pump chambers; and an actuator, which actuates the diaphragms to compress or decompress the pump chambers;

wherein the actuator is formed with a plurality of intake holes, and each of the diaphragm is provided with an intake valve section communicated with an associated one of the intake holes.

2. The pump as set forth in claim 1, wherein the intake valve section is a flap member formed by incising a part of each diaphragm.

* * * * *